United States Patent [19]

Brown et al.

[11] Patent Number: 4,588,299

[45] Date of Patent: May 13, 1986

[54] CEMENT MIXING PROCESS AND APPARATUS

[75] Inventors: Ronald O. Brown, Gloucester; Ernest J. Delorme, London, both of Canada

[73] Assignees: Alslur Enterprises Limited, Gloucester; Contran Manufacturing (1982) Limited, London, both of Canada

[21] Appl. No.: 655,935

[22] Filed: Sep. 28, 1984

[30] Foreign Application Priority Data

Oct. 18, 1983 [CA] Canada ..... 439241

[51] Int. Cl.[4] ..... B28C 7/04

[52] U.S. Cl. ..... 366/8; 366/18

[58] Field of Search ..... 55/256, 385 R; 134/171; 366/2, 3, 8, 10, 13, 14, 15, 16, 18, 30, 34, 40, 67, 75, 138, 141, 152, 162, 179, 181, 182, 189, 192

[56] References Cited

U.S. PATENT DOCUMENTS

| | | | |
|---|---|---|---|
| 1,546,335 | 7/1925 | Browne | 366/34 |
| 3,967,815 | 7/1976 | Backus | 366/64 |
| 4,104,736 | 8/1978 | Mendenhill | 366/25 |
| 4,182,617 | 1/1980 | Al-Saidi | 55/256 |
| 4,205,919 | 6/1980 | Attwell | 366/34 |
| 4,459,028 | 7/1984 | Bruder | 366/141 |
| 4,498,783 | 2/1985 | Rudolf | 366/141 |

*Primary Examiner*—Robert W. Jenkins

*Attorney, Agent, or Firm*—Frishauf, Holtz, Goodman & Woodward

[57] ABSTRACT

A novel apparatus and process for producing cement slurry on a batch basis is disclosed. During the charging of a slurry batcher with water and cement, the cement dust so produced is captured and added back to the slurry being batched in order to minimize health and environmental hazards created by the cement dust. This is achieved by passing or venting entrapped air and dust in the batcher through air vent and cement dust collection means which in one embodiment comprises a water reservoir through which the air and dust passes. Dust is captured by the reservoir water and the reservoir water then discharged into the batcher so as to become part of the slurry batch with known and pre-determined amounts of water and cement in the slurry.

8 Claims, 5 Drawing Figures

CEMENT MIXING PROCESS AND APPARATUS

BACKGROUND

This invention relates to a novel process and apparatus used in producing a cement slurry on a batch basis.

In the production of concrete, the pre-mixing of cement and water to form a cement slurry is known. Following the production of the slurry or cement paste, it is then normally added to aggregate (sand, gravel or both) to produce the concrete mix. Concrete mixing plants of this type are disclosed, for example, in U.S. Pat. No. 1,923151—Koehring, and in U.S. Pat. No. 2,015,488—Manabe, Sept. 24, 1935.

With the relatively recent advent of concrete trucks, it has become common practice to use the truck mounted mixer for the purpose of mixing water, cement and aggregate separately added thereto in pre-determined quantities. Characteristic of the existing cement plants used, say, for the production of cement block or on-site casting as well as concrete mixing in transit (truck) mixers, is the undesirable side effect of cement dust or cement spillage upon transport from the cement silo direct to the truck or indeed, to the cement slurry batcher.

In addition to cement dust being a environment and health hazard, from a commercial standpoint, it also contributes to significant lost time and attendant labour costs in washing down or otherwise removing the undesired dust or cement spills. Currently, it is not uncommon for concrete mixer truck operations, following charging of the mixer with cement, to spend from five to ten minutes washing down the accumulated cement dust with a water hose and approximately one-half hour doing the same thing following a day's operation.

SUMMARY OF THE INVENTION

In accordance with our novel apparatus and process, cement slurry can be quickly and repeatedly mixed on a batch basis with no or little environmental cement dust being produced and in so doing, the process also allows concrete mixers, such as truck mounted concrete mixers, to be charged with the cement in slurry form without fear of additional dust pollution.

Although the pre-measured quantities of cement and water added to the slurry mixer can be regulated or controlled prior to their introduction into the slurry mixer as contemplated, for example, by Manabe in U.S. Pat. No. 2,015,488, in accordance with one preferred embodiment of my invention, it is possible to employ only one control means for regulating the amount of water and the amount of cement so introduced. In its simplest form, this is controlled and determined by regulating and thus determining the weight of the water added to the slurry mixer and similarly, weighing and determining the amount of cement added to the mixer thereby obviating the need of separate measuring devices for both the amount of water and amount of cement added.

In order to mix the cement and water in accordance with my invention, it is important that the cement slurry batcher be a substantially closed vessel into which the water and cement is added. Because the vessel is effectively closed, entrapped air contained therein must be exhausted at least during the addition of a pre-determined amount of cement since, on a volume basis significantly more cement than water is added to the vessel. As cement dust is carried by the vented air resulting from its displacement by the addition of cement, provision is made for air vent and cement dust collection means which communicates with the ambient air and which vents the otherwise entrapped air within the vessel.

In one preferred embodiment of my invention, the air vent and cement dust collection means includes a water reservoir and conduit means for passing the entrapped air and cement dust through water contained in the reservoir.

In accordance with yet another preferred embodiment of my invention, the water within the reservoir can itself, following the venting of the vessel, be added or discharged into the cement slurry. In so doing, the cement dust contaminated reservoir water is itself taken up in the slurry and not disgarded as a pollutant. Where a water filter and vent arrangement is employed and the waste water (i.e. the water containing cement dust) is added to the slurry, the amount of water in this reservoir or secondary chamber can advantageously be included in the predetermined amount of water that is added to the vessel during each batch operation.

In accordance with the foregoing the novel cement slurry batcher of my invention used in mixing on a batch basis a pre-determined amount of cement with a pre-determined amount of water, comprises a substantially closed batching vessel for receiving said water and said cement. Cement inlet and water inlet means is provided in the batcher as is mixing means for mixing said water and said cement into a slurry. Slurry discharge means is provided on the bottom of the batching vessel. Control means is also employed for regulating the amount of water and the amount of cement introduced into the vessel during each batch and as above indicated, air vent and cement dust collection means communicating with the ambient air is employed for venting entrapped air and collecting cement dust carried thereby during at least the introduction of said cement into the vessel.

The amount of added water and cement can be determined and measured externally of the vessel or controlled and regualted, on a weight basis, by determining the weight of the water in the vessel and the weight of the cement in the vessel.

In one preferred form, the air vent and cement dust collection means includes a water reservoir and conduit means for passing said entrapped air and cement dust through water contained in said reservoir. The water containing cement dust collected or otherwise filtered therethrough preferrably is discharged into the vessel following the addition of cement with the amount of water contained in the reservoir being calculated into the overall pre-determined amount of water added to the vessel during each batching operation. One simple form of air vent and cement dust collection means employing a water reservoir is the provision of conduit means which, at one end, communicates with the interior of the vessel and which, at the other end, ends below the surface of the water such that cement dust entrapped air vented from the vessel is obliged to bubble or otherwise pass through the water in the reservoir.

The cement dust contaminated water can be gravity or pressure fed directly into the slurry mixer from the reservoir positioned above, or optionally, directed to introduce itself at selected locations within the mixer for the purpose of a more uniform introduction to the existing slurry.

When practising the process of my invention, a first major quantity of a pre-determined amount of water is added to the substantially closed mixing vessel or batcher and a second minor quantity of said predetermined amount of water is added to a water reservoir or secondary reservoir. A pre-determined amount of cement is then added to the vessel and mixed with the first major quantity of water. The cement dust produced within the vessel during the addition of cement is vented as exhausted air through the second minor quantity of water. Thereafter, this second minor quantity of air which has picked up the cement dust exhausted from the vessel, is added to the first major quantity of water and the cement which is undergoing slurry mixing.

As in the case of the above described apparatus of my invention, the pre-determined amounts of water and cement used during each batch can be determined externally of the slurry mixing vessel prior to addition or, and as is preferred, simply determined and controlled by measuring or monitoring the weight of the water and the weight of cement added to the vessel.

In yet accordance with another feature of my invention, both the apparatus and the process of it can be carried out merely by retrofitting many existing concrete plants.

BRIEF DESCRIPTION OF DRAWINGS

In the accompanying drawings which illustrate only one working embodiment of the invention.

DETAILED DESCRIPTION OF DRAWINGS

Figure 1:
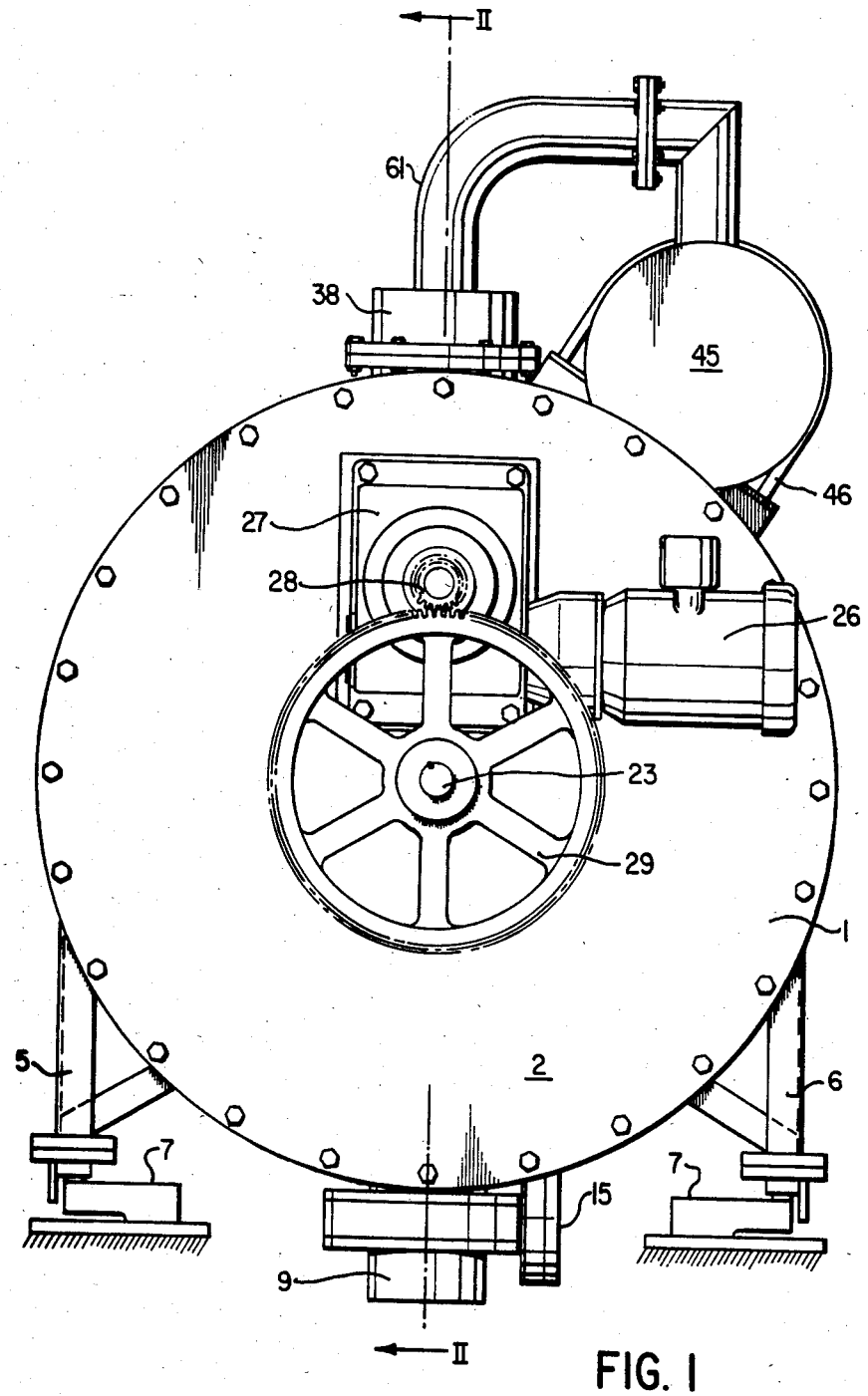
FIG. 1 is an end view of the cement slurry batcher which also illustrates the drive means connected to the mixing means internally of the batcher.

For ease of understanding, and where convient to do so, the same identifying reference numerals have been used in all of the drawings to indicate like parts.

Figure 2:
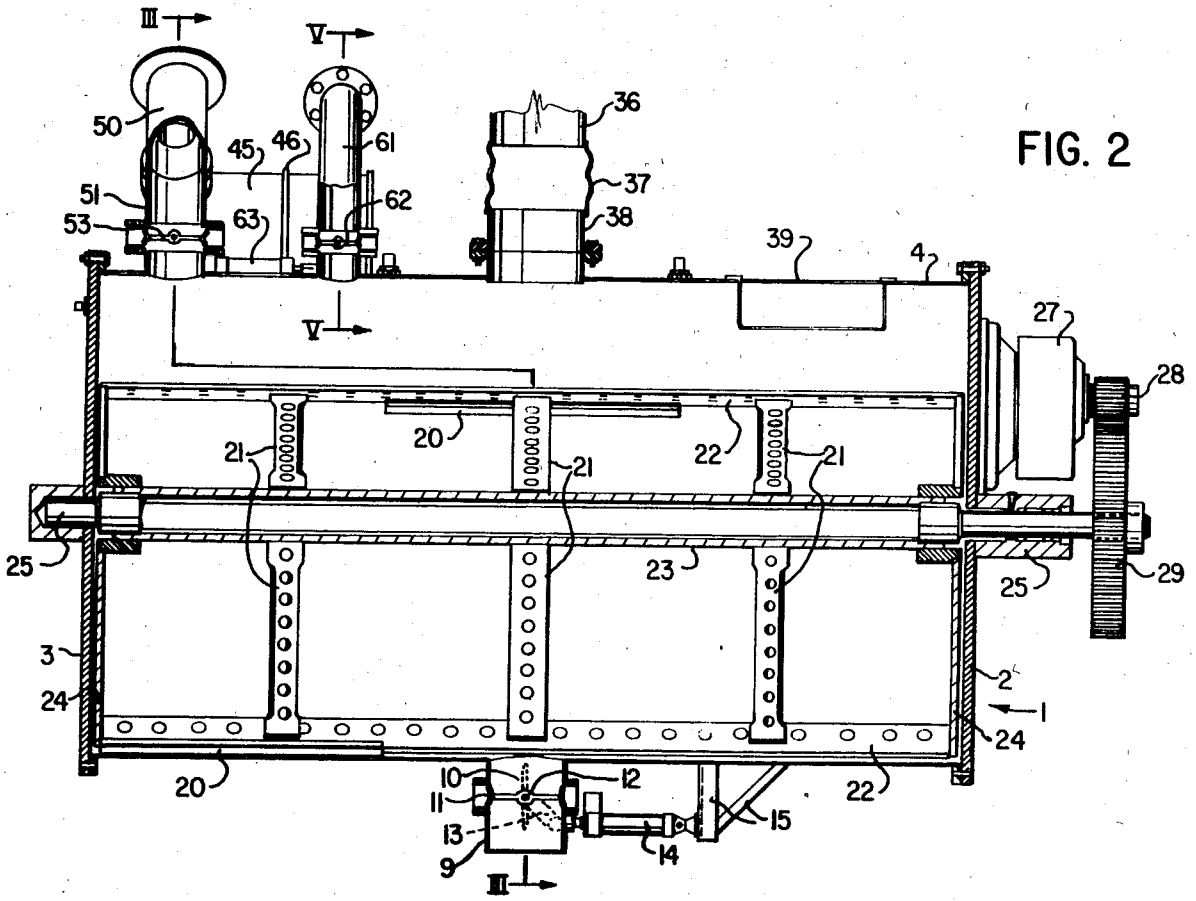
FIG. 2 is a cross sectional view of the batcher taken along the lines II—II of FIG. 1.
Figure 3:
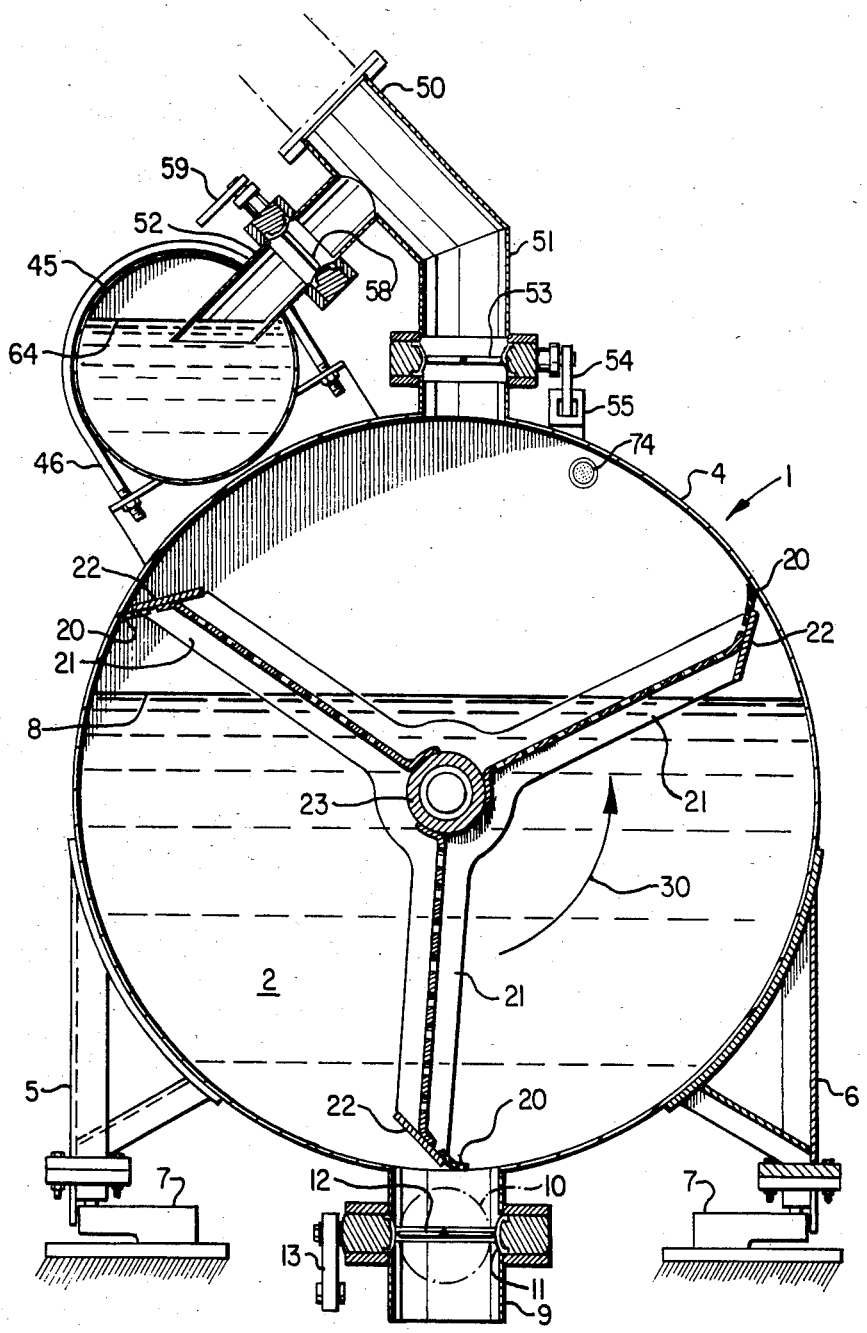
FIG. 3 is a further cross sectional view of the cement slurry batcher taken along the lines III—III of FIG. 2.

With principal reference to FIGS. 1, 2 and 3, the slurry batcher is generally indicated by reference numeral I and includes end wall portions 2 and 3 and a central mixing drum or cylinder 4. Batcher 1 is supported by a centrally located drum support leg 5 on one side and two spaced apart drum legs 6 on the opposite side and carried by support or base brackets 8 with load cells which are generally located and generally indicated at 7 and as discussed in greater detail below. Load cells 7 themselves are carried by a supporting framework (not shown) as is well known in the art.

Discharge pipe 9 for discharging the slurry mixed within batcher 1 is located on the underside of a drum 4. Included on pipe 9 is closure or butterfly valve 10 adapted to sealingly engaged closure gasket 11. One end of a shaft 12 of valve 10 is connected to crank arm 13 with the valve being opened and closed by solonoid actuated air cylinder 14 carried on support bracket 15 in a well known manner. The batcher itself may be elevated on supports (not shown) in order to permit a concrete truck to drive thereunder and receive the cement slurry discharged through pipe 9.

The mixing means located internally of batcher 1 may be of any suitable form of construction but as illustrated, employs a elongate shaft 23 central of mixing drum 4 and supported at end walls 2 and 3 by shaft end bearings generally indicated at 25. Radial arms 21 extend radially outward from and are fixed to rotatable central shaft 23. The free ends of the radial arms are connected to elongate cross supports 22 which in turn include wiper blades 20 as best seen in FIG. 3 and which are intended to wipe the interior wall of mixing drum 4 while rotated in the direction of arrow 30. End supports 24 connect cross supports 22.

Figure 4:
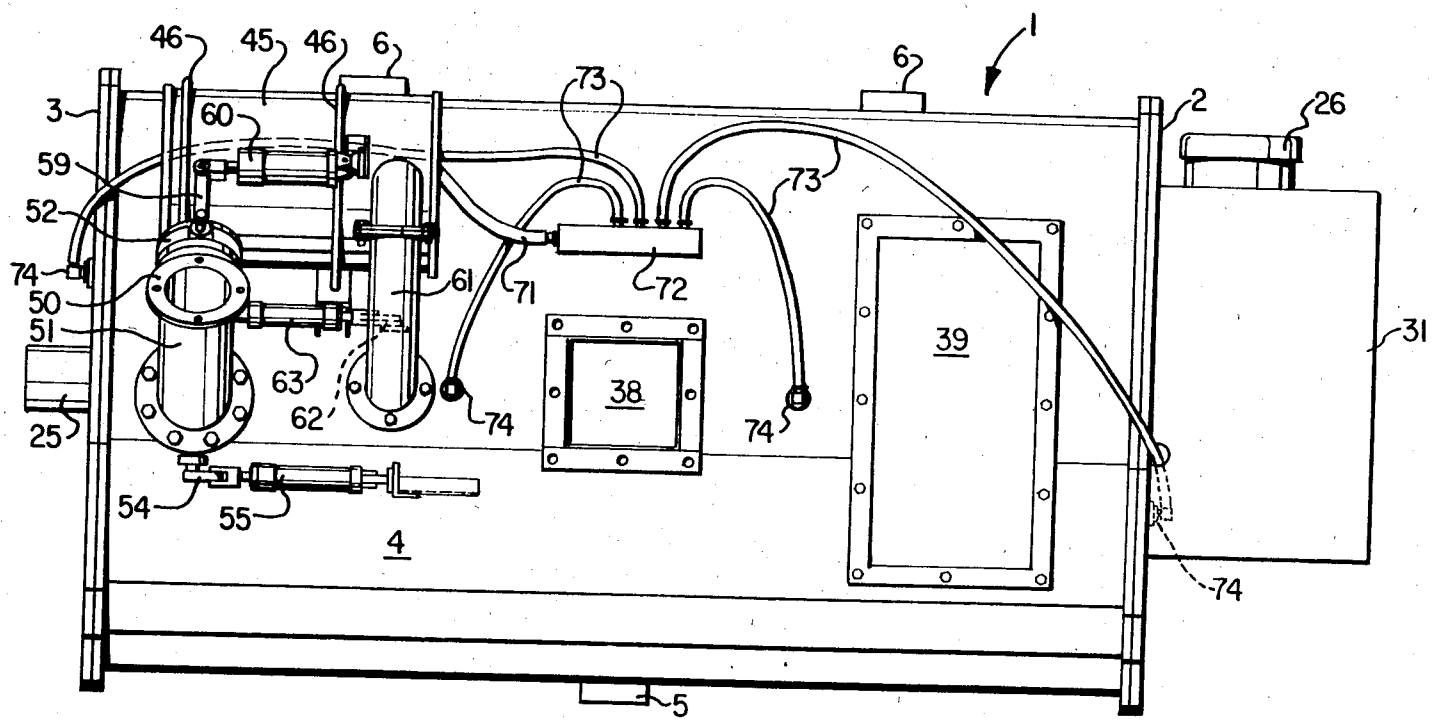
FIG. 4 is a top plan view of the slurry mixer and which additionaly shows a cover plate over the drive means seen in FIG. 1.

As best seen in FIG. 1, electric drive motor 26, reduction gearbox 27 with drive pinion 28 are supported on end wall 2. Driven gear 23 is also carried externally of wall 2 and is fixed key connected to shaft 23 in order to rotate the slurry mixing means as above described. A cover plate 31 for this drive means can be mounted over the motor, gearbox and driven gear as illustrated in FIG. 4.

A discharge pipe 36 connected to a cement supply hopper (not shown) is turn connected to cement inlet tube 38 located on the top of batcher 1 as best seen in FIG. 2, with pipe 36 being connected to tube 38 by flexible boot 37. A shut off valve for discharge tube 36 (not shown) is provided and functions in a manner similar to slurry valve 10 for controlling the amount of cement permitted to enter drum 4. Also provided on the top of this drum is removable inspection and service cover or port 39.

Water is introduced into the batcher through pipe 51 connected to supply pipe 50 which also communicates with secondary water supply pipe 52 as best illustrated in FIG. 3 and which terminates interiorally of secondary water drum or resevoir 45 attached to mixing drum 4 by mounting brackets or straps generally indicated at 46. Inlet pipe 51 additionally includes a main water shut off valve 53 which, as before, is connected to actuation lever arm 54 and air driven solonoid valve or piston 55 so as to control the entry of water internally of the batcher. In a like manner, secondary drum inlet pipe 51 includes a further shut off valve 58 controlled by lever arm 59 actuated by air piston 60.

Figure 5:
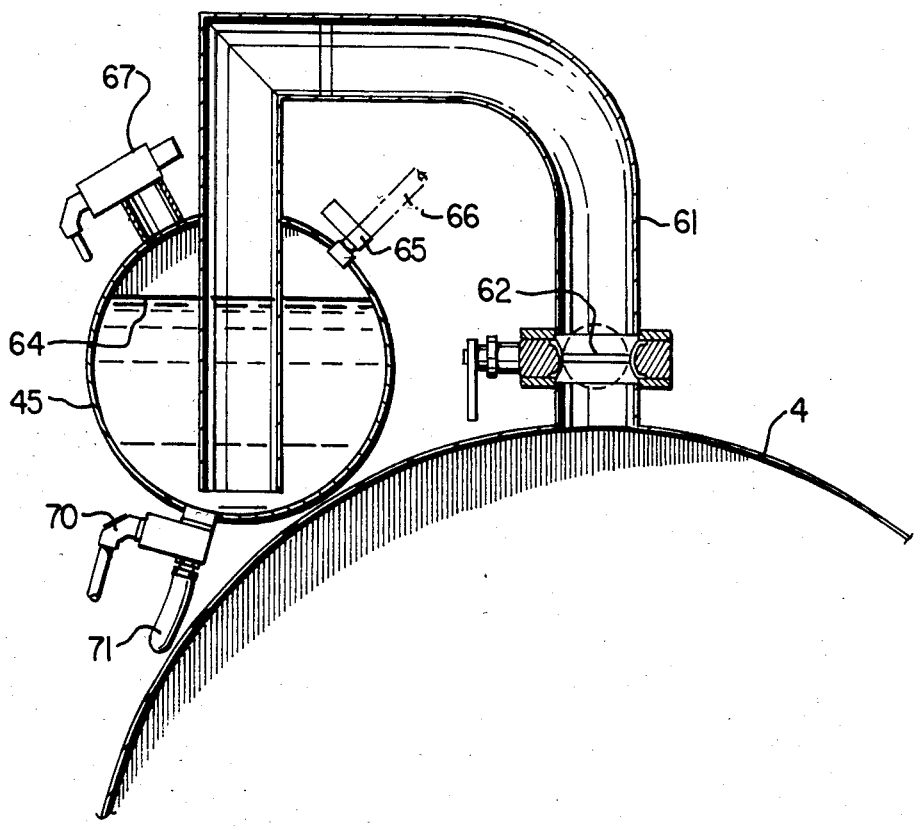
FIG. 5 is a cross sectional view of the air vent and secondary water tank taken along the lines V—V of FIG. 2.

As best seen in FIG. 5, secondary water drum 45 also includes a breather shut off valve generally indicated at 67 and which, when opened permits the interior of drum 45 to communicate with the ambient air. Valve 67 together with solonoid actuated valve 65 are both positioned above water level 60 of the water in drum 45 as discussed in greater detail below. Solonoid valve 65 controls the entry of compressed air into drum 45 supplied by compressed air supply hose 66.

As also indicated in FIG. 5 air vent pipe 61 communicates with the interior of batcher 1 and the interior of drum 45 so as to extend below water level 64. Again, a lever and valve arrangement generally indicated at 62 serves to shut off the air vent upon actuation of air piston 63.

A further solonoid actuated control valve 70 is positioned approximate the bottom of secondary water drum 45 which, when opened, permits the water in this drum to flow via pipe 71 to a flushing manifold or distributor 72 as illustrated in FIG. 4. Also connected to flushing manifold 72 are a series of distribution pipes 73 which, at their ends remote from the manifold, terminate and communicate with the interior of the batcher at flushing nozzles 74 which serves to spray water into batcher. As illustrated, two flushing nozzles are located on the top of the batcher and two flushing nozzles 74 are provided on the end walls 2 and 3 of the batcher. As described in greater detail hereinbelow, the content of water in secondary water tank 45 is drained off and introduced internally of drum 1 to assist in washing and interior walls of the drum.

When air vent valve 65 is opened and the water in secondary water drum 45 is at level 64, with solonoid valve 67 being opened and communicating with the ambient air, upon introduction of cement interiorally of the batcher via supply pipe 38, air and cement dust within the batcher displaced by the addition of cement, is permitted to pass through air vent pipe 61 and bubble through and thus be effectively filtered by the water in drum 45.

At initial start up, valve 10 is closed as is the valve on the cement hopper supply (not shown). Valves 53 and 58 on the water supply pipes 51 and 52 are also closed as is valve 70 and compressed air valve 65 while breather shut off valve 67 communicating with the ambient air is opened. The weight of the overall batcher is then determined employing load cells 7 in a manner as is well known in the art.

Since the ratio of water to cement for a given batch is pre-determined, valves 58 and 53 are then opened permitting the entry of water into batcher 1 and resevoir 45. Upon the water in drum 45 reaching level 64, valve 58 is automatically closed whereupon water is permitted to continually add to drum 4. Once the cumulative weight of the water in resevoir 45 and batcher 1 reaches a predetermined value over the weight of the empty batcher and which represents the volume of water to be included in the batch, valve 53 is closed in a known manner; the weight of water and the batcher being determined by the weight upon load cell 7.

The mixing means internally of the batcher can be started up prior to or during the water addition as desired. The level of both the water and cement being shown as 8 in FIG. 3. Thereafter, air vent valve 62 is opened as is the valve on the hopper (not shown) to permit cement to enter the batcher. The hopper valve is caused to automatically shut off in a known manner when the weight of the batcher, the weight of the water and the weight of the cement added there to meets a pre-set value representing the desired ratio of cement to be added to the water. As the batcher is effectively closed, the cement is mixed with the water within the batcher and the attendant dust is carried off by the displaced air within the batcher as it is permitted to exhaust itself by passage through air vent 61 the water in drum 45 and finally through breather shut off valve 67 which is in the open position to the ambient air; the dust carried by this expelled air being effectively filtered out by being bubbled through and absorbed by the water in drum 45.

It will be recognized that at this stage, the desired ratio of water to be mixed with the cement in making up the slurry has not been fully introduced or mixed into the cement since a quantity of water remains in drum 45. To achieve the proper mixing ratio, the water within drum 45, which also contains collected cement dust captured during the introduction of cement into drum 45, is introduced into this drum for mixing.

In the particular embodiment illustrated, this is achieved by the closure of air vent valve 62 and breather shut off valve 65 and the opening of flushing valve 70 which thereby permits the water in the 45 tank to follow through valve 70 and pipe 71 to manifold 72 and thence via distributor pipes 73 to flush this water carrying the accumulated cement dust through flushing nozzles 74 for discharge into the batcher. The pressure head on this flushed water and the flushing action of the water discharged through nozzle 74 is significantly improved by utilizing air pressure supply hose 66 and opening valve 65 communicating with the interior of drum 45. Once the resevoir water is added, the resultant slurry has the desired water to cement ratio and following the desired mixing is then discharged from the batcher upon opening valve 10.

It will also be apparent that when practicing this invention, the water deficient slurry can be expelled via valve 10 prior to flushing the batcher with the water of drum 45. Where, say, concrete mixing trucks are employed, the water depleted slurry can be first introduced into the concrete truck and the balance of the water, following flushing, then also introduced into the truck by merely leaving valve 10′open until the next batching operation. In this application, final slurry mixing would take place in the mixing truck.

From the foregoing, it will be seen that the cement dust is contained during a slurry mixer charging and furthermore, only one weight controller for measuring both the desired amount of cement and the desired amount of water is needed. Aggregate can be then mixed with the obtained slurry in any desired manner, such as, for example, adding the aggregate to the concrete mixer of a truck following the slurry addition.

We claim:

1. A cement slurry batcher for mixing on a batch basis, a predetermined amount of cement with a predetermined amount of water, said batcher comprising:

(a) a substantially closed batching vessel for receiving said water and said cement, (b) cement inlet means, (c) water inlet means, (d) mixing means for mixing said water and said cement into a slurry, (e) slurry discharge means, (f) control means for regulating the predetermined amount of water and the predetermined amount of cement introduced into the vessel during each batch, and (g) air vent and cement dust collection means for venting entrapped air within said vessel exteriorly thereof and for collecting cement dust carried thereby during at least the introduction of said cement into said vessel, and which includes a water reservoir and conduit means for passing said entrapped air and cement dust carried thereby through water contained in said reservoir, said water reservoir further including water discharge means for discharging the water and collected cement dust from said reservoir to said vessel and wherein the water in the reservoir is included in said predetermined amount of water.

2. The cement slurry batcher as claimed in claim 1, wherein the predetermined amount of water added to said vessel is controlled by the weight of the water in said vessel, and the predetermined amount of cement added to said vessel is controlled by the weight of the cement in said vessel.

3. The cement slurry batcher as claimed in claim 1, wherein the predetermined amount of cement and the predetermined amount of water added to the vessel during each batch is predetermined prior to the introduction of said water and said cement into said vessel.

4. The cement slurry batcher as claimed in claim 1, wherein said conduit means at one end communicates with the interior of said vessel and at another end terminates below the level of water in said water reservoir.

5. A process for producing a cement slurry on a batch basis comprising:

(a) adding a major quantity of predetermined amount of water to a substantially closed mixing vessel and a second minor quantity of said predetermined amount of water to a secondary reservoir, (b) adding a predetermined amount of cement to said vessel and to said first major quantity of water, (c) venting exhausted air and cement dust produced by the addition of said cement to said mixing vessel through said second minor quantity of water and thereafter adding said second minor quantity of water to said first major quantity of water and cement in said mixing vessel, and (d) mixing at least said first major quantity of water and said cement within said vessel to form a cement slurry.

6. The process as claim in claim 5 wherein said first major quantity of water, cement and said second minor quantity of water are mixed together.

7. The process as claimed in claim 5 wherein the pre-determined amount of water and the pre-determined amount of cement is determined by measuring the weight of said first major and second minor quantity of water and by measuring the weight of said cement added to said vessel.

8. The process as claimed in claim 5, wherein said cement slurry is discharged direct into a concrete mixer, and mixed with a pre-determined amount of aggregate separately added to said concrete mixer.

* * * * *